US008075345B2

(12) United States Patent
Peng

(10) Patent No.: US 8,075,345 B2
(45) Date of Patent: Dec. 13, 2011

(54) ELECTRICAL CONNECTOR

(75) Inventor: Jian-Min Peng, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 70 days.

(21) Appl. No.: 12/778,713

(22) Filed: May 12, 2010

(65) Prior Publication Data

US 2011/0143599 A1 Jun. 16, 2011

(30) Foreign Application Priority Data

Dec. 16, 2009 (CN) ..... 2009 1 0213882

(51) Int. Cl.
*H01R 24/00* (2006.01)
*H01R 33/00* (2006.01)

(52) U.S. Cl. ..... 439/660; 439/638

(58) Field of Classification Search ..... 439/638, 439/660
See application file for complete search history.

(56) References Cited

U.S. PATENT DOCUMENTS 7,988,499 B2 * 8/2011 Lin et al. ..... 439/701
2009/0181578 A1 * 7/2009 Chen et al. ..... 439/625
2011/0143599 A1 * 6/2011 Peng ..... 439/660

FOREIGN PATENT DOCUMENTS

CN 200820005770.5 12/2008

* cited by examiner

*Primary Examiner* — James Harvey
(74) *Attorney, Agent, or Firm* — Muncy, Geissler, Olds & Lowe, PLLC

(57) ABSTRACT

An electrical connector includes a main body, a tongue board located at the front end of the main body, a plurality of first pins and second pins which are located on the main body and extended into the tongue board. One side of the tongue board forms an operation surface. Each first pin has a first contact portion exposed outside of the operation surface. Each first contact portion defines a first contact area. At least one first contact portion defines a second contact area. The second contact area of the first contact portion is closer to the front end of the tongue board than the first contact area. Each second pin has a second contact portion exposed outside of the operation surface, and the second contact portions are respectively located at the rear end of the first contact portion. The electrical connector can be plugged by plugs with different formats.

18 Claims, 9 Drawing Sheets

ELECTRICAL CONNECTOR

BACKGROUND OF THE INVENTION

1. Field of the Invention

The present invention relates to an electrical connector. In particular, the present invention relates to an electrical connector that can be plugged with a variety of plugs with different protocols.

2. Description of Related Art

China patent, ZL200820005770.5, discloses an electrical connector. The electrical connector can be plugged by at least two kinds of plug with different protocols. The electrical connector includes a housing having a plug slot, an external serial ATA (eSATA) pin set, and a universal serial bus (USB) pin set. A fastening base is located in the plug slot. The external serial ATA pin set is located at one side of the fastening base, and has a plurality of first eSATA pins and a plurality of second eSATA pins. The universal serial bus pin set is located at another side of the fastening base, corresponds to the external serial ATA pin set, and has a plurality of first USB pins and a plurality of second USB pins. The second USB pins are connected with the second eSATA pins. The second USB pins are used for USB3.0 plug. By connecting the second USB pins with the second eSATA pins, the second USB pins utilize the second eSATA pins to transmit data signals.

Although the electrical connector can be matched with one of the three plugs, eSATA, USB2.0 or USB3.0 protocol, it still has the following drawbacks. First, because the eSATA pin set and the USB pin set of the electrical connector are located at two sides of the fastening base respectively, the contact portions of the corresponding plugs are also located at two sides of the fastening base. If we define that the eSATA plug is plugged normally, and the USB plug is plugged inversely instead of the eSATA plug, the user is perplexed for these different formats. Further, when the electrical connector is manufactured, the contact area of the eSATA pin corresponding to the eSATA plug is different from that corresponding to the USB3.0 plug and there is a long distance between them, the electroplating area for the eSATA pin becomes larger so that the manufacturing cost increases.

SUMMARY OF THE INVENTION

One particular aspect of the present invention is to provide an electrical connector that can be plugged with a variety of plugs with different protocols. It is easy to operate the electrical connector and the manufacturing cost is decreased.

The electrical connector includes a main body, a tongue board located at the front end of the main body, a plurality of first pins located on the main body and extended into the tongue board, and a plurality of second pins located on the main body and extended into the tongue board. One side of the tongue board forms an operation surface. Each of the first pins has a first contact portion exposed outside of the operation surface. Each of the first contact portions defines a first contact area and at least one first contact portion defines a second contact area. Each of the second pins has a second contact portion exposed outside of the operation surface, and the second contact portions are respectively located at the rear end of the first contact portion.

For electrical connector of the present invention, each of the first pins has a first contact portion exposed outside of the operation surface, each of the first contact portion defines a first contact area, at least one first contact portion defines a second contact portion, and each of the second pins has a second contact portion exposed outside of the operation surface. Thereby, when the electrical connectors with different formats are plugged, all electrical connectors transmit the electrical signals at the same side of the tongue board. It is easy to operate it and the manufacturing cost is reduced.

For further understanding of the present invention, reference is made to the following detailed description illustrating the embodiments and examples of the present invention. The description is for illustrative purpose only and is not intended to limit the scope of the claim.

DETAILED DESCRIPTION OF THE PREFERRED EMBODIMENTS

Figure 1:
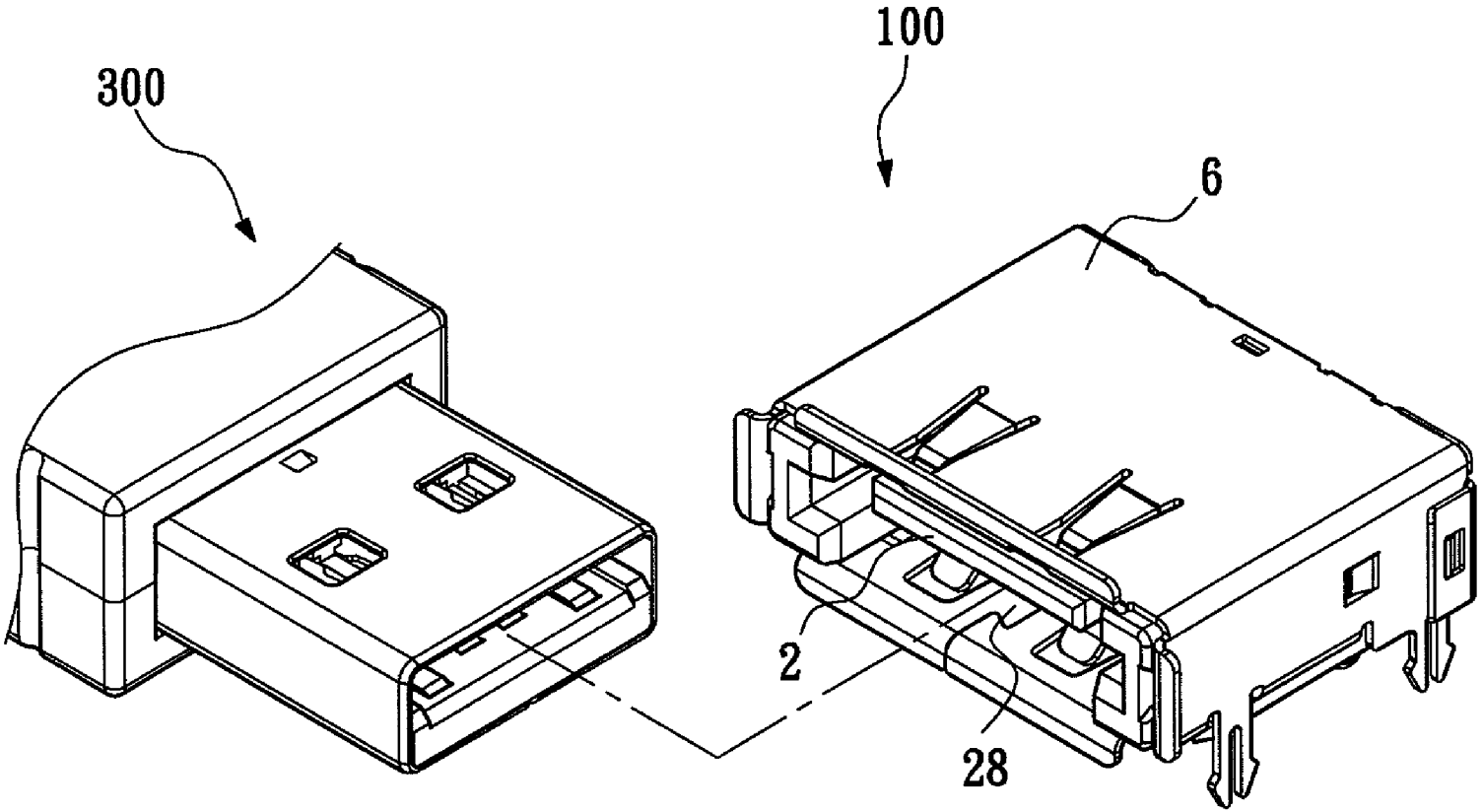
FIG. 1 is a perspective view of the electrical connector of the present invention being applied to an USB plug.
Figure 2:
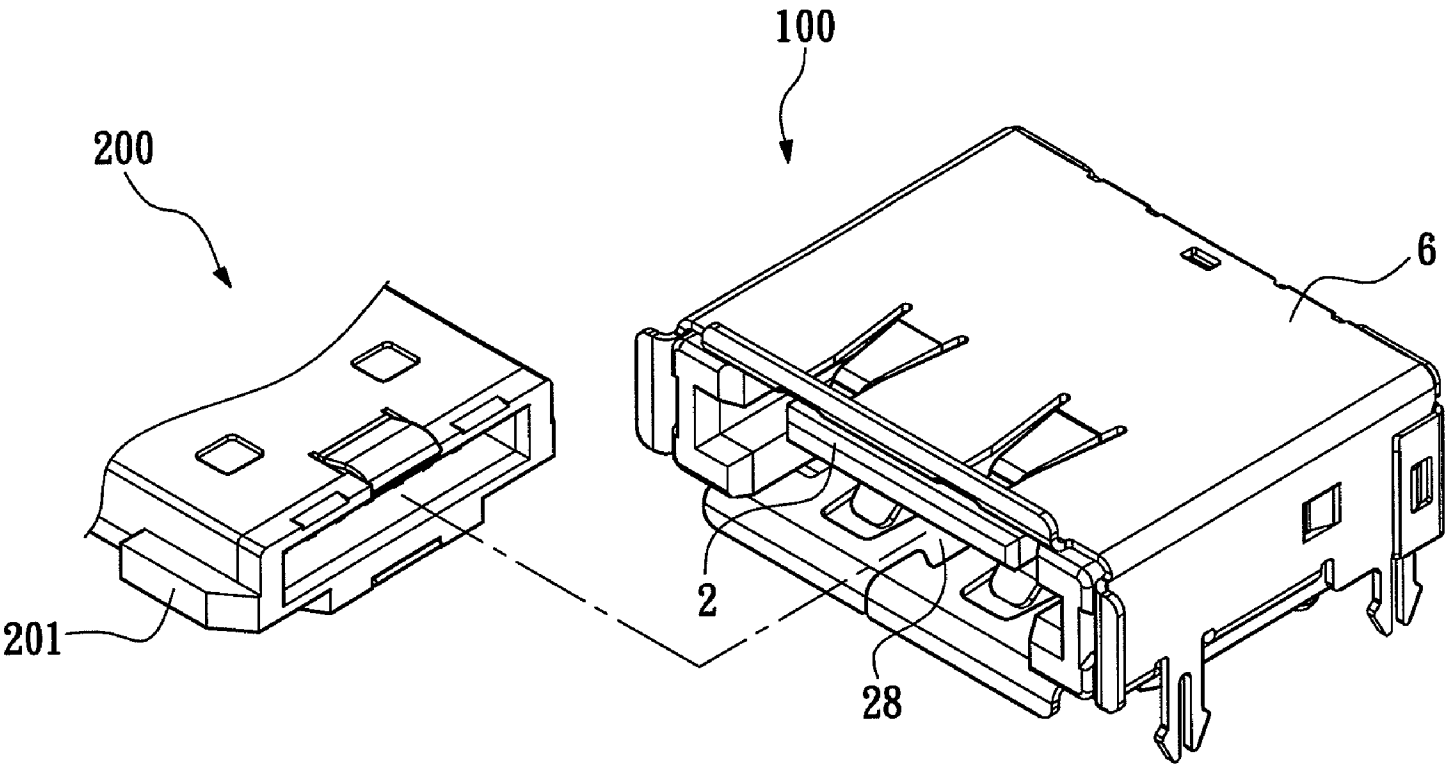
FIG. 2 is a perspective view of the electrical connector of the present invention being applied to a eSATA plug.
Figure 3:
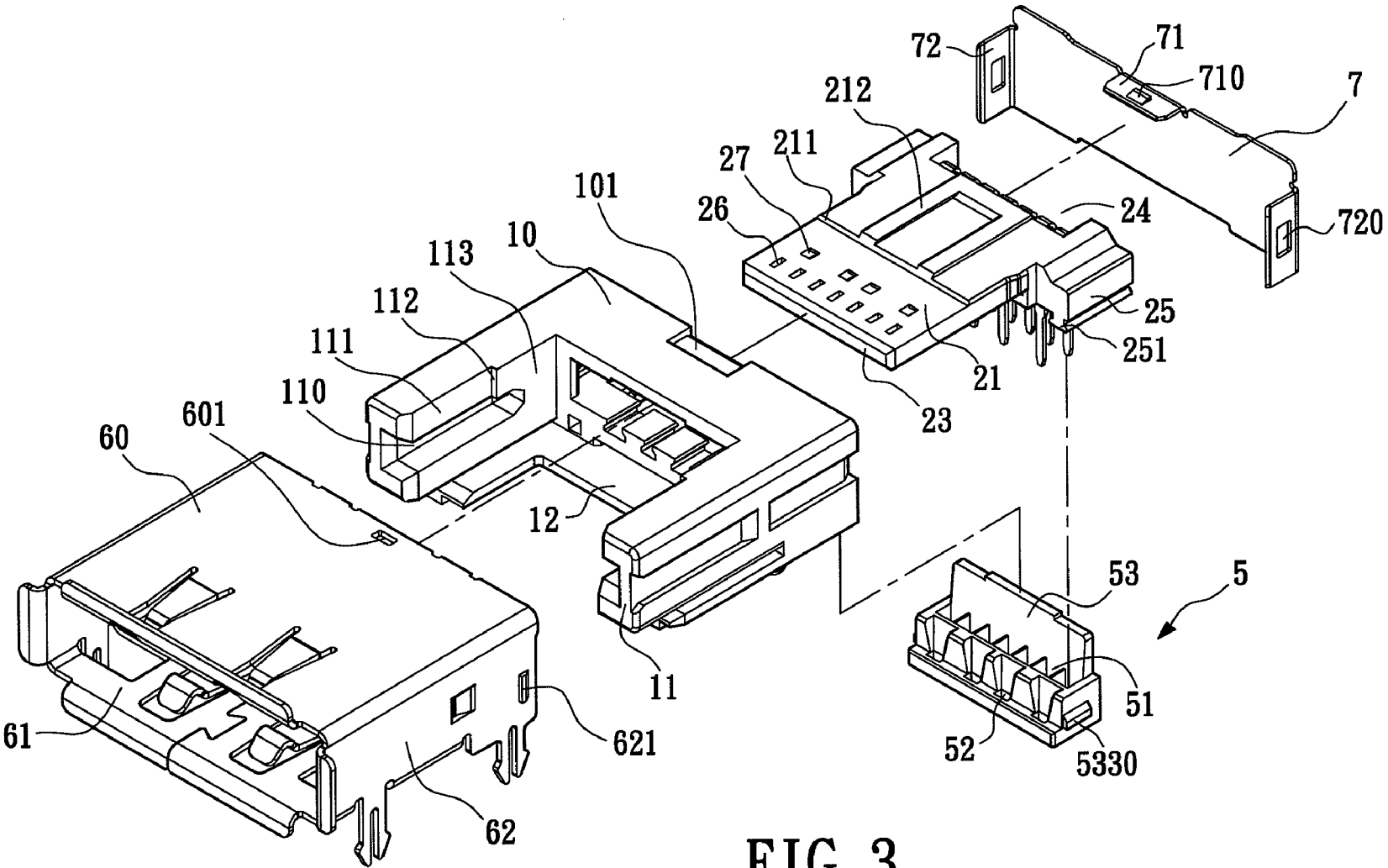
FIG. 3 is an exploded perspective view of the electrical connector of the present invention.
Figure 4:
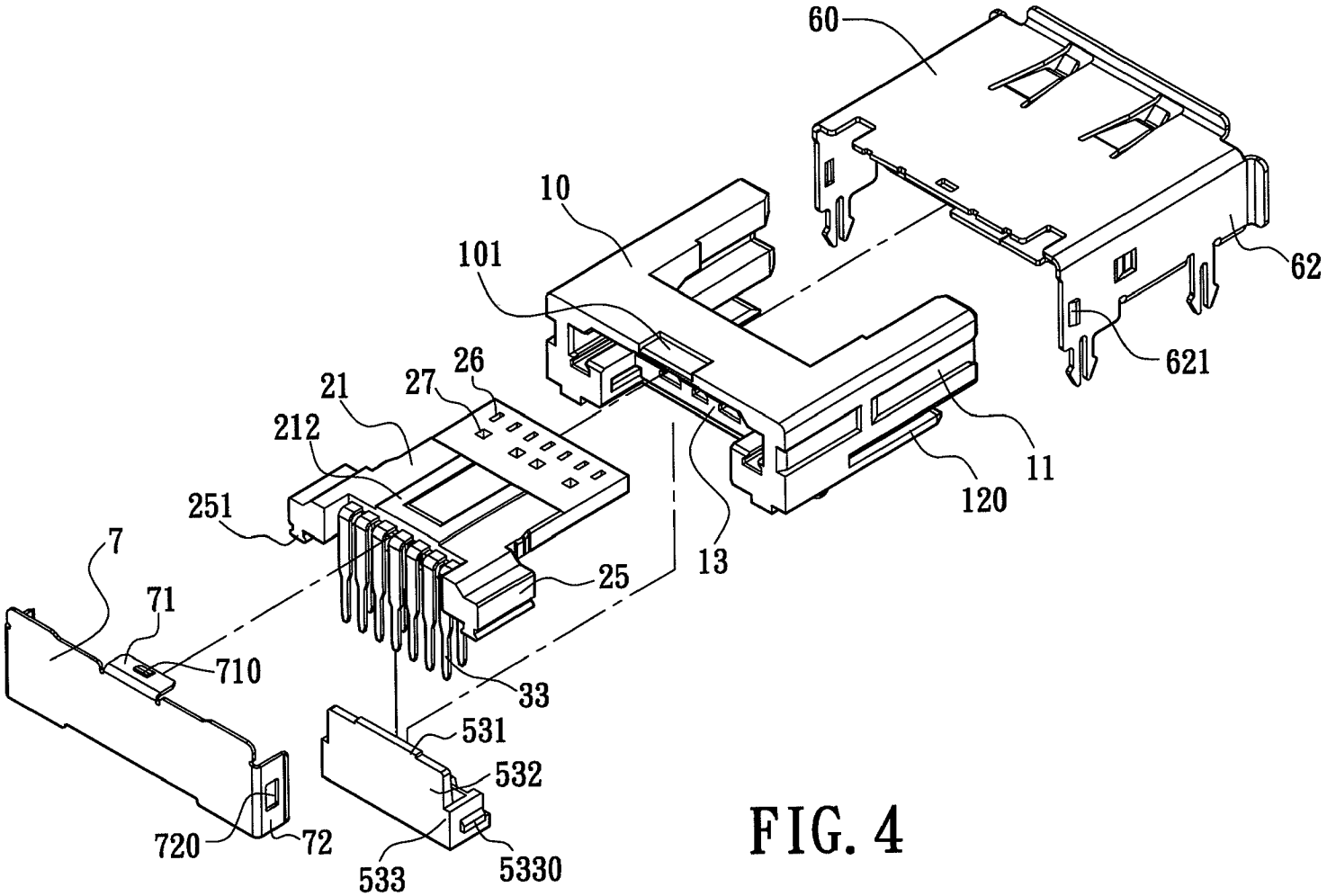
FIG. 4 is a second exploded perspective view of the electrical connector of the present invention taken from different viewing angle.
Figure 5:
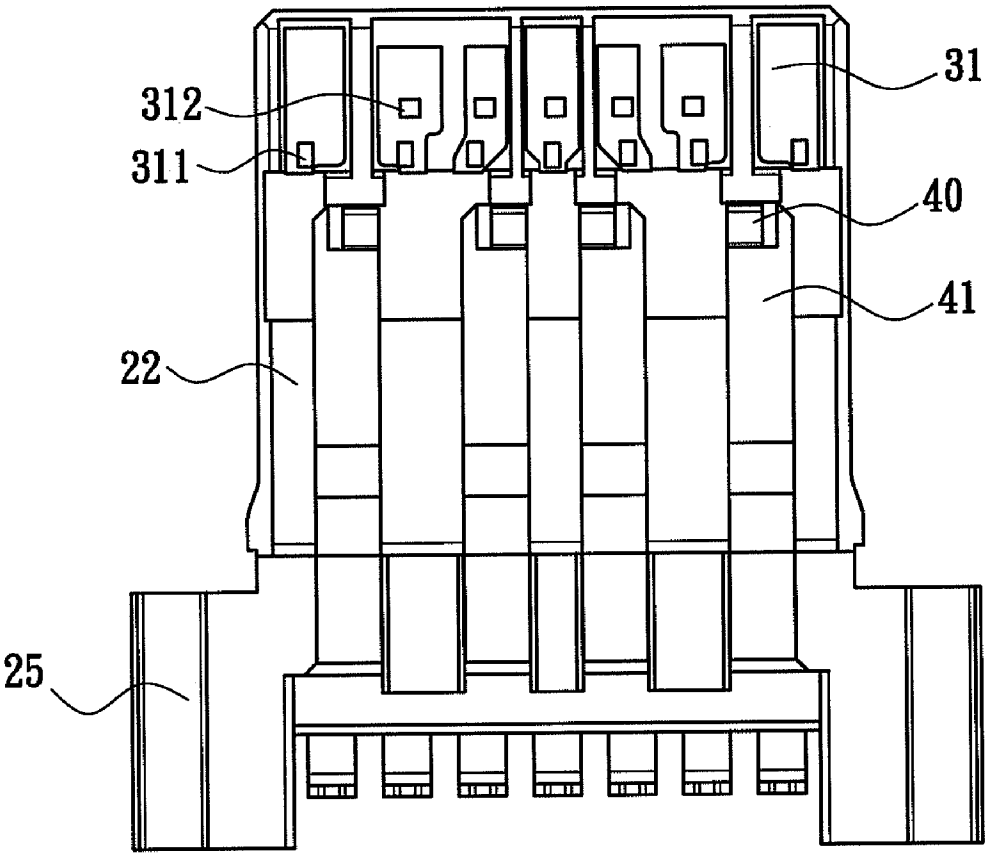
FIG. 5 is a bottom view of the tongue board shown in FIG. 3.
Figure 6:
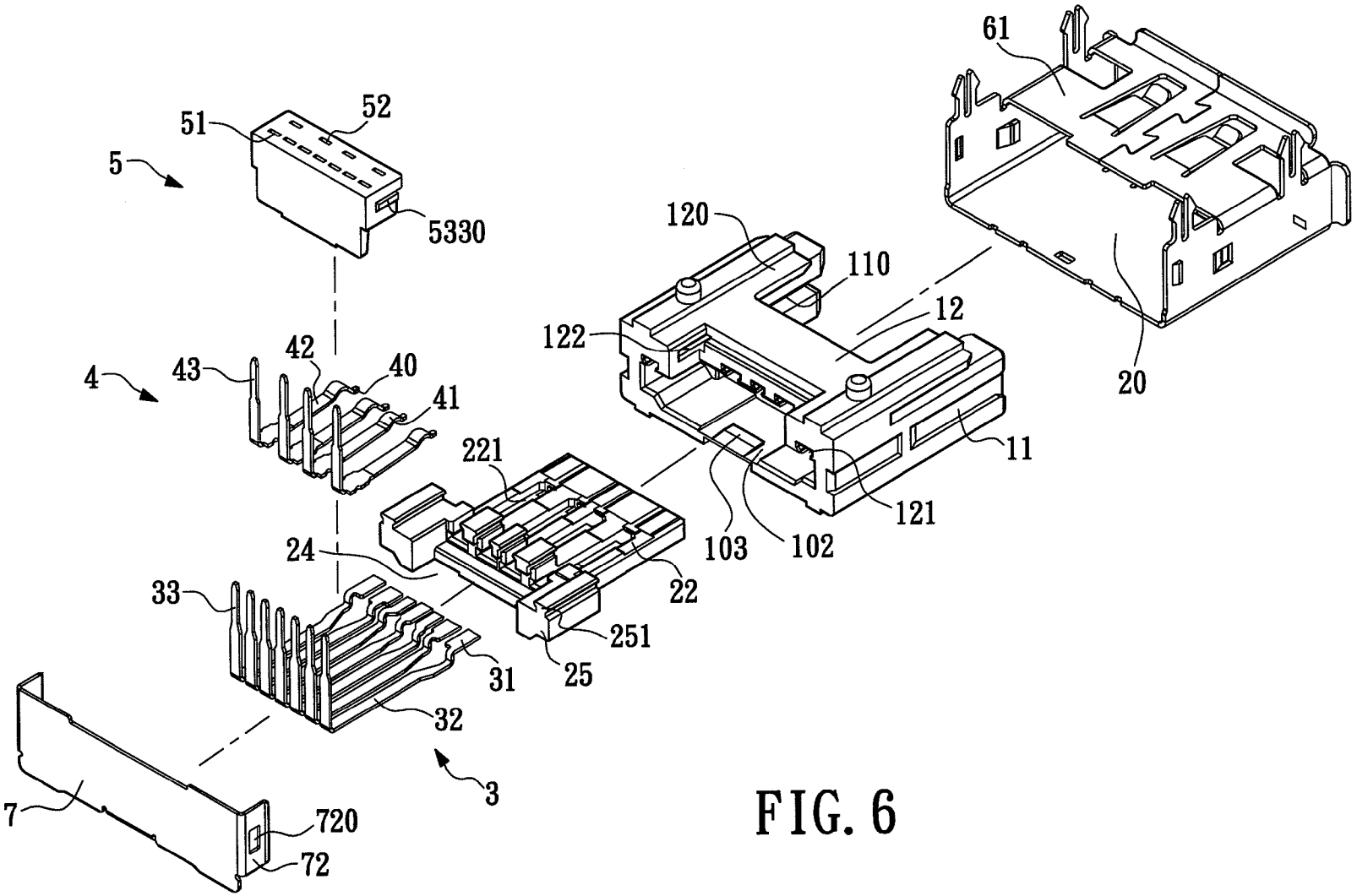
FIG. 6 is a third perspective view of the electrical connector of the present invention taken from different viewing angle.
Figure 7:
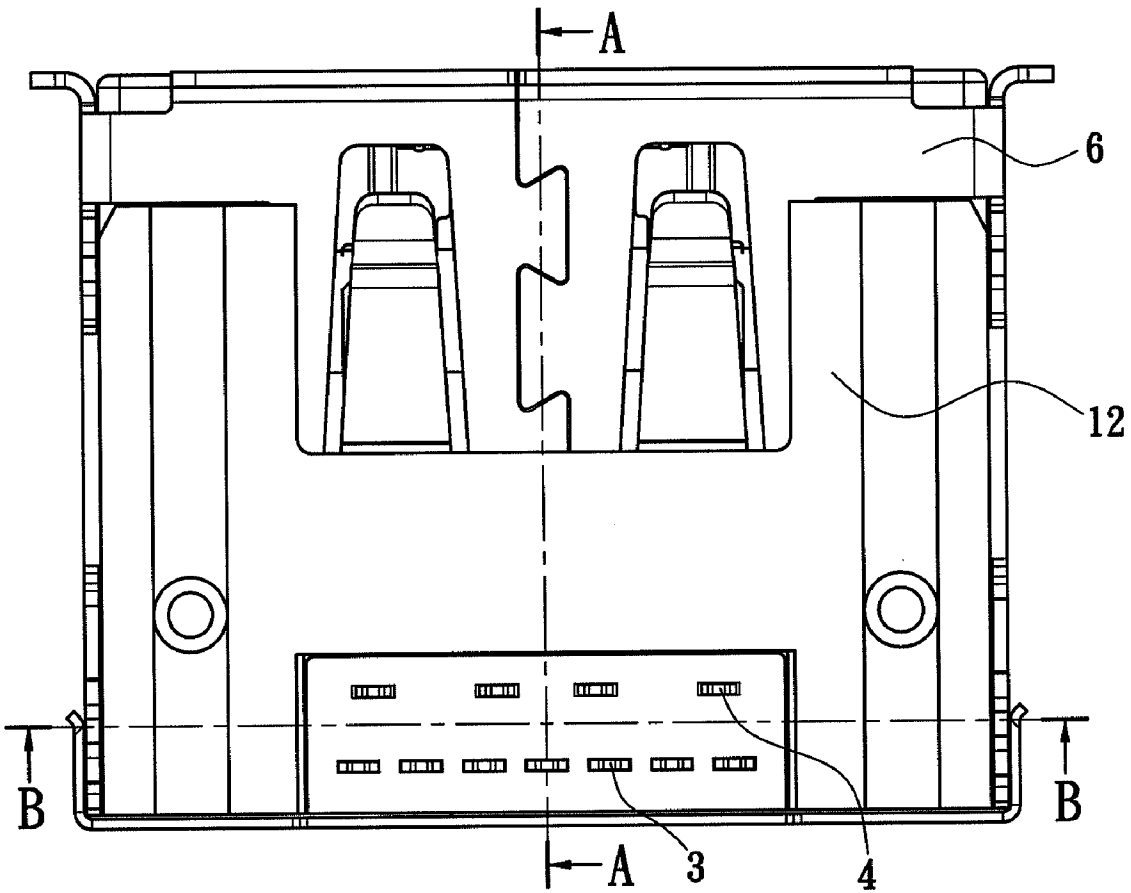
FIG. 7 is a bottom view of the electrical connector of the present invention.
Figure 8:
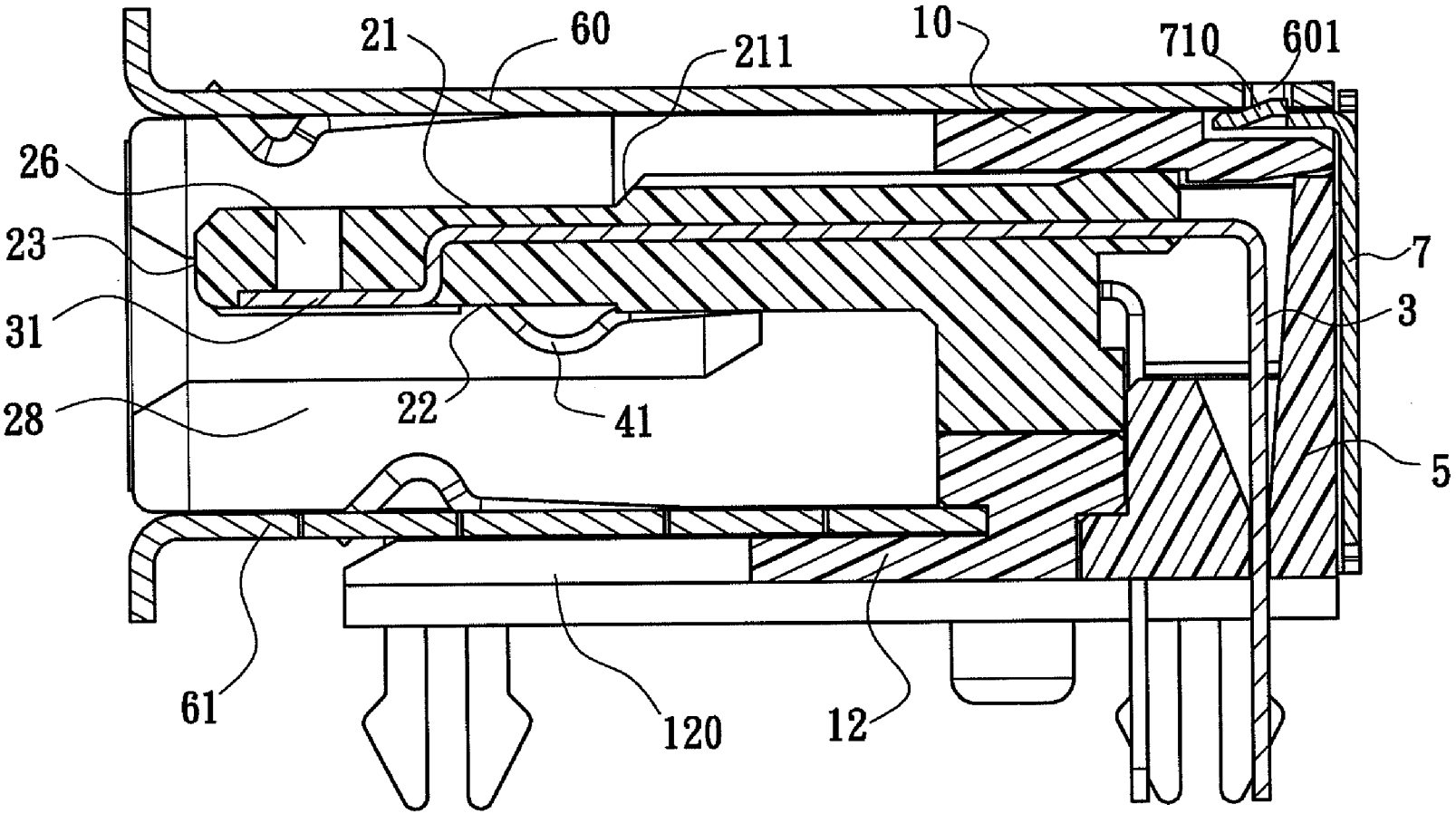
FIG. 8 is a cross-sectional view of the cross-section A-A in FIG. 7 being turned with 180 degrees.
Figure 9:
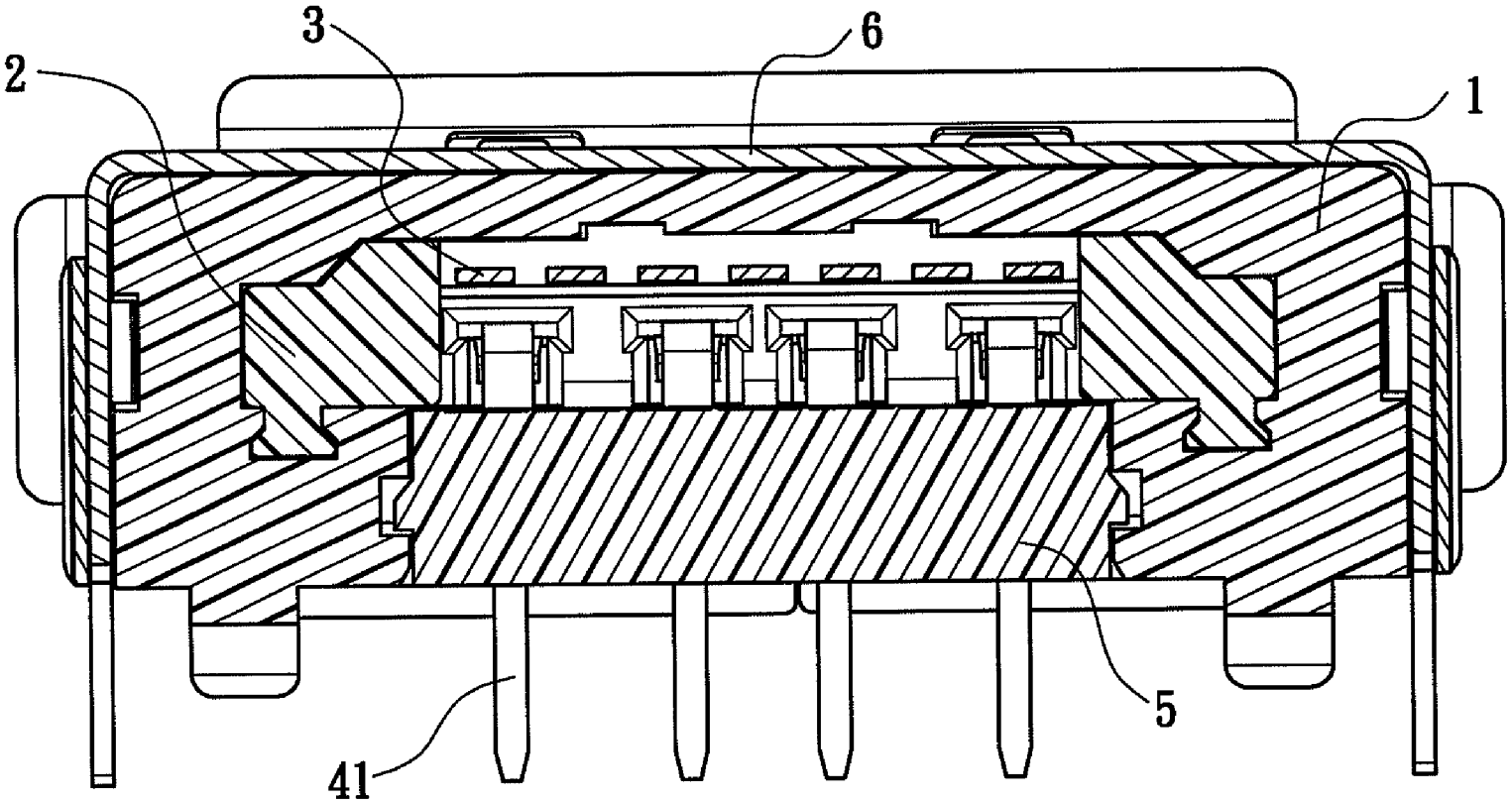
FIG. 9 is a cross-sectional view of the cross-section B-B in FIG. 7 being turned with 180 degrees.

Reference is made to FIGS. 1 and 2. The electrical connector 100 can be selectively plugged with a first matching connector 200, a second matching connector 300, and a third connector. In this embodiment, the first matching connector 200 belongs to the eSATA format, the second matching connector 300 belongs to the USB3.0 format, and the third connector belongs to the USB2.0 format The electrical connector 100 includes a main body 1, a tongue board 2, a plurality of first pins 3, a plurality of second pins 4, a fastening base 5, a metal housing 6, and a rear cover 7. The first pins 3 and the second pins 4 are located on the tongue board 2. The tongue board 2 is assembled on the main body 1 and the fastening base 5. The metal housing 6 and the rear cover 7 wrap the assembled body. The metal housing 6, the rear cover 7 and the main body 1 can be treated as a wrapping body. The front end of the wrapping body forms a plug interface 20.

From the bottom view or the top view, the main body 1 is made of insulating material and is concave-shaped. The main body 1 includes a top board 10, two side walls 11, and a bottom board 12. The top board 10 and the bottom board 12 are oppositely located. The two side walls 11 are located at the two opposite sides of the top board 10. There is an installation space 13 between the top board 10 and the bottom board 12. The top board 10 and the bottom board 12 can be treated as a base portion.

The two opposite inner wall surfaces of the front end of the two side walls 11 are symmetrical, and are composed of a first inner wall surface 111, a second inner wall surface 112 and a third inner wall surface 113. The second inner wall surface 112 makes the first inner wall surface 111 and the third inner wall surface 113 be ladder-shaped (means a height difference exists). The front end of each side walls 11 still has a concave trough 110. The first inner wall surface 111 and the second inner wall surface 112 are located above the concave trough 110. Therefore, the third inner wall surface 113 is laterally located around the concave trough 110 and is L-shaped. Below the two side walls 11, there are the two arms 120 extended from the two sides of the bottom board 12. There is a gap between the side wall 11 and the arm 120.

The top surface of the top board 10 has a first concave 101. The bottom surface has a second concave 102. There is a convex block 103 in the second concave 102. The bottom board 12 forms a plurality of positioning troughs 121. The inner wall surface of the bottom board 12 forms a fastening trough 122.

The tongue board 2 passes through the installation space 13 and is assembled on the front end of the main body 1. The tongue board 2 is located in the plug interface 20, and has a non-operation surface 21 and an operation surface 22 that are oppositely located. The non-operation surface 21 is located at the upper side and the operation surface 22 is located at the lower side. There is a connection surface 23 between the non-operation surface 21 and the operation surface 22. The connection surface 23 is vertical to the operation surface 22. The operation surface 22 forms a plurality of receiving troughs 221 that are disposed in parallel. The rear end of the tongue board 2 has a concave opening 24.

The non-operation surface 21 has a U-shaped convex portion 212. The convex portion 212 corresponds to the second concave 102, and the convex block 103 corresponds to the middle location of the non-convex portion of the convex portion 212. The non-operation surface 21 is not a flat surface, and has a ladder surface 211. The two sides of the rear end of the tongue board 2 extend to form a side board 25 respectively. The lower side of the side board 25 extends to form a positioning block 251. The side board 25 corresponds to the outlook of the installation space 13, and the positioning block 251 is wedged with the positioning trough 121.

The first pin 3 is embedded and formed on the tongue board 2, and each pin 3 includes a first contact portion 31, a first weld portion 33 bent downwards and extended from the tongue board 2, and a first connection portion 32 connecting the first contact portion 31 with the first weld portion 33. The first contact portion 31 is plate-shaped and exposed outside of the operation surface 22. The location of the tongue board 2 that corresponds to the first contact portion 31 has a fastening hole 26. When the forming process is performed, the fastening hole 26 is used for fastening the first contact portion 31 in the tongue board 2. During the insulating material is filled, the filling force of the insulating material will not deform the first pins 3.

The second pin 4 is assembled on the tongue board 2. The second pin 4 includes a second contact portion 41, a second weld portion 43 bent downwards and extended from the tongue board 2, and a connection portion 42 connecting the second contact portion 41 with the second weld portion 43. The front end of the second contact portion 41 warps upwards and extends to form a block portion 40. The tongue board 2 has a through hole 27 for receiving the block portion 40. The second pin 4 is received into the receiving troughs 221. The first pin 3 is embedded and formed on the tongue board 2. Before the first weld portion 33 is bent downwards, the second pin 4 is assembled on the tongue board 2. Next, the first weld portion 33 of the first pin 3 is bent downwards.

The fastening base 5 has two parallel of plug holes that are defined as a first plug hole 51 and a second plug hole 52. The first plug hole 51 receives the first weld portion 33, and the second plug hole 52 receives the second weld portion 43. The rear wall 53 of the fastening base 5 has three width portions that the widths of the three width portions are different. From up to down, there are the first width portion 531, the second width portion 532, and the third width portion 533. The first width portion 531 corresponds to the second concave 102. The second width portion 532 corresponds to the concave opening 24. The two outer sides of the third width portion 533 respectively have a wedging block 5330 that is wedged with the fastening trough 122.

The metal housing 6 is a frame body that is punched and bent. The metal housing 6 is formed by a top wall 60, a bottom wall 61 and two side walls 62. The top wall 60 has a positioning opening 601. The rear ends of the two side walls 62 have convex blocks 621. The upper side of the rear cover 7 extends to form a first extend portion 71. The two sides of the rear cover 7 respectively extend to form a second extend portion 72. The first extend portion 71 has a wedge portion 710 that corresponds to the positioning opening 601. The second extend portion 72 has a positioning through hole 720 that corresponds to the convex block 621. The bottom wall 61 occupies the gap between the side wall 11 and the arm 120. The operation surface 22 and the warping body form a connection-guiding space 28.

The first pins 3 are defined as 3*a*, 3*b*, 3*c*, 3*d*, 3*e*, 3*f*, and 3*g* in a sequence. The 3*a*, 3*d* and 3*g* are grounding pins. The 3*b* and 3*c*, and 3*e* and 3*f* respectively form a pair of differential signal pins.

When the first matching connector 200 is plugged, the first matching connector 200 is electrically connected with the first contact portion 31 exposed outside of the operation surface 22. The location of the first contact portion 31 that corresponds to the first matching connector 200 is defined as a first contact area 311. The second inner wall surface 112 blocks the first matching connector 200 so that the first matching connector 200 is electrically connected with the first contact portion 31. The two side block blocks 201 of the first matching connector 200 are received in the concave trough 110. The distances between the first contact areas 311 are equal and the first contact areas 311 are disposed in parallel.

When the second matching connector 300 is plugged, the second matching connector 300 is electrically connected with the first pins 3*b*, 3*c*, 3*d*, 3*e*, 3*f*, and the second pin 4. The location of the first contact portion 31 of the first pins 3*b*, 3*c*, 3*d*, 3*e*, 3*f* that correspond to the second matching connector 300 are defined as the second contact area 312. The connection surface 23 blocks and orientates the second matching connector 300 so that the second matching connector 300 is electrically connected with the second contact portion 41 at the second contact area 312. The distances between the second contact areas 312 are equal and the second contact areas 312 are disposed in parallel.

When a third matching connector (not shown) is plugged, the connection surface 23 blocks the third matching connector. The third matching connector is only electrically connected with the second pin 4, and is electrically connected with the second contact portion 41.

Relative to prior art, because the electrical connector 100 makes the second inner wall surface 112 move forwards, the second contact area 312 is closer to the connection surface 23 than the first contact area 311. Alternatively, when the length of the first contact portion 31 that is along the lengthwise direction of the tongue board 2 is adequate, the first contact area 311 is closer to the connection surface 23 than the second contact area 312. Its principle is still within the scope of the present invention. Furthermore, the second inner wall surface 112 also can be located on the ladder surface 211 to achieve the same function or effect. By locating the second inner wall surface 112 on a proper location, part of the first contact area 311 and the second contact area 312 are overlapped or aligned along an intersection direction. The second inner wall surface 112 also can be replaced by a flexible flake that is punched from the metal housing 6 and is forward the direction of the plug interface. The second inner wall surface 112 that is used as a block portion or a reference surface also can be located on both the main body 1 and the tongue board 2.

The present invention has the following characteristics.

1. The first contact area 311 and the second contact area 312 are located on the same first contact portion 31, and exposes outside of the operation surface 22. The second contact portion 41 also exposes outside of the operation surface 2. Therefore, when eSATA, USB2.0 or USB3.0 connector is plugged, the connector is electrically connected in the connection-guiding space 28 formed by the operation surface 22 and the warping body. It is convenient for the user to change the connectors with different formats.

2. When the first, second and third connector are selectively plugged, the connectors with different formats are plugged into the different locations of the electrical connector 100. The electrical connector 100 of the present invention uses the second inner wall surface 112 as a block portion or a reference surface to position the first matching connector 200 to be electrically connected at the first contact area, so that the plug location of the first matching connector 200 is controlled. The connection surface 23 positions the second matching connector 300 to electrically connect the second contact portion 41 at the second contact area 312, and also position the third connector to electrically connect the second contact portion 41. The plug location of the second matching connector 200 and the third connector is also controlled. The structure is simple.

3. The first pin 3 can be used as a signal channel of the first matching connector 200, some of the first pins 3 are used as signal channels of the second matching connector 300, and both use the first contact portion 31 of the same plane. Therefore, the electroplating area of the first pin 3 is reduced. The manufacturing cost is reduced.

4. Because the first pin 3 is embedded and formed on the tongue board 2, the manufacturing process is simplified and the cost is reduced. When the first pin 3 is assembled on the tongue board 2, the deformation or damage problem due to interference is avoided. The first pin 3 can be leaned on the tongue board 2.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. An electrical connector, comprising:

a main body, a tongue board located at a front end of the main body, wherein one side of the tongue board forms an operation surface;

a plurality of first pins located on the main body and extended into the tongue board, wherein each of the first pins has a first contact portion exposed outside of the operation surface, each of the first contact portions defines a first contact area and at least one first contact portion defines a second contact area, the second contact area of the first contact portion is closer to a front end of the tongue board than the first contact area; and a plurality of second pins located on the main body and extended into the tongue board, wherein each of the second pins has a second contact portion exposed outside of the operation surface, and the second contact portions are respectively located at the rear end of the first contact portion;

a wrapping body includes the main body and a metal housing wrapping the main body;

a block portion is located on the main body;

the main body includes a base portion and at least one side wall extended from the base portion, and the block portion is an inner wall surface of the side wall that faces to a plug interface.

2. The electrical connector as claimed in claim 1, wherein a part of the first contact area and the second contact area are aligned along an insertion direction.

3. The electrical connector as claimed in claim 1, wherein the first contact portion is plate-shaped.

4. The electrical connector as claimed in claim 1, wherein the distances between the first contact areas are equal and the first contact areas are disposed in parallel.

5. The electrical connector as claimed in claim 1, wherein the distances between the second contact areas are equal and the second contact areas are disposed in parallel.

6. An electrical connector, for selectively connecting a first matching connector and a second matching connector with different formats, comprising:

a wrapping body, wherein the front end of the wrapping body forms a plug interface, the wrapping body has a block portion, and the block portion is used for positioning the first matching connector;

a tongue board installed in the plug interface of the wrapping body, wherein one side of the tongue board and the wrapping body form a connection-guiding space, and the front end of the tongue board has a connection surface for positioning the second matching connector;

a plurality of first pins and a plurality of second pins located at the wrapping body and extended into the tongue board, wherein each of the first pins has a first contact portion, the first contact portion selectively and electrically connects the first matching connector and the second matching connector, wherein each of the second pins has a second contact portion, and the second contact portion connects the second matching connector;

wherein the first contact portion and the second contact portion both face towards the connection-guiding space; and the first contact portion has a contact location corresponding to the second matching connector which is closer to the connection surface than a contact location corresponding to the first matching connector;

the wrapping body includes a main body and a metal housing wrapping the main body;

the block portion is located on the main body;

the main body includes a base portion and at least one side wall extended from the base portion, and the block portion is an inner wall surface of the side wall that faces to the plug interface.

7. The electrical connector as claimed in claim 6, wherein the first contact portion is plate-shaped.

8. The electrical connector as claimed in claim 6, wherein a part of the contact location corresponding to the second matching connector is aligned along an insertion direction with a part of the contact location corresponding to the first matching connector.

9. The electrical connector as claimed in claim 6, wherein the block portion is located at the rear end of the connection surface, and relative to connection-guiding space, the block portion is located above the connection surface.

10. The electrical connector as claimed in claim 6, wherein the second contact portion is located at the rear end of the first contact portion.

11. An electrical connector, for selectively connecting a first matching connector and a second matching connector with different formats, comprising:

a main body;

a tongue board located at the front end of the main body, wherein the tongue board has a connection surface and an operation surface that are disposed transverse to each other;

a plurality of first pins and a plurality of second pins located in the main body and extended into the tongue board, wherein each of the first pins has a first contact portion that exposes outside of the operation surface, each of the first contact portions defines a first contact area and at least one first contact portion defines a second contact area, and each of the second pins has a second contact portion that exposes outside of the operation surface; a reference surface located at the main body, the tongue board, or both, wherein the reference surface positions the first matching connector to electrically connect the first contact area; wherein the connection surface blocks and orientates the second matching connector to electrically connect the second contact portion at the second contact area, and the second contact area is closer to the connection surface than the first contact area;

wherein the main body has a base portion and at least one side wall extended from the base portion, and the reference surface is the inner wall surface of the side wall.

12. The electrical connector as claimed in claim 11, wherein the distances between the second contact areas are equal and the second contact areas are disposed in parallel.

13. The electrical connector as claimed in claim 11, wherein the side wall forms a concave trough, and the reference surface is close to another surface of the tongue board that is opposite to the operation surface.

14. The electrical connector as claimed in claim 6, wherein the block portion is located at the metal housing.

15. The electrical connector as claimed in claim 11, wherein the tongue board has a non-operation surface that is opposite to the operation, the non-operation surface has a ladder surface, and the reference surface is the ladder surface.

16. The electrical connector as claimed in claim 11, wherein part of the first contact area and the second contact area are aligned along an insertion direction.

17. The electrical connector as claimed in claim 11, wherein the first contact portion is plate-shaped.

18. The electrical connector as claimed in claim 11, wherein the distances between the first contact areas are equal and the first contact areas are disposed in parallel.

* * * * *